US007892104B2

(12) United States Patent
Laden

(10) Patent No.: US 7,892,104 B2
(45) Date of Patent: Feb. 22, 2011

(54) GOLF STANCE AND BALL ALIGNMENT DEVICE

(76) Inventor: Mark Noam Laden, Ha'horesh Street 48, Kefar Shmaryahu (IL) 46910

( * ) Notice: Subject to any disclaimer, the term of this patent is extended or adjusted under 35 U.S.C. 154(b) by 0 days.

(21) Appl. No.: 12/710,519

(22) Filed: Feb. 23, 2010

(65) Prior Publication Data

US 2010/0216567 A1 Aug. 26, 2010

Related U.S. Application Data

(60) Provisional application No. 61/154,755, filed on Feb. 23, 2009.

(51) Int. Cl.
*A63B 69/36* (2006.01)

(52) U.S. Cl. ..... 473/270; 473/218

(58) Field of Classification Search ..... 473/218, 473/266, 268, 270–273, 279
See application file for complete search history.

(56) References Cited

U.S. PATENT DOCUMENTS

| | | | | |
|---|---|---|---|---|
| 3,459,429 | A * | 8/1969 | Green | 473/218 |
| 3,708,174 | A * | 1/1973 | Kamarauskas | 473/273 |
| 5,203,453 | A * | 4/1993 | Dirito | 206/315.3 |
| 5,944,613 | A * | 8/1999 | Dubois | 473/218 |
| 6,440,004 | B1 * | 8/2002 | Rodriguez | 473/218 |

* cited by examiner

*Primary Examiner*—Nini Legesse

(57) ABSTRACT

A device used for achieving correct stance, ball position and alignment in the game of golf is disclosed. The device includes a reel, attachable to a first shoe of a golf player, a string or tape, the first end of which is connected to the reel and which is wound/unwound respectively onto/from the reel, and a fastener.

20 Claims, 4 Drawing Sheets

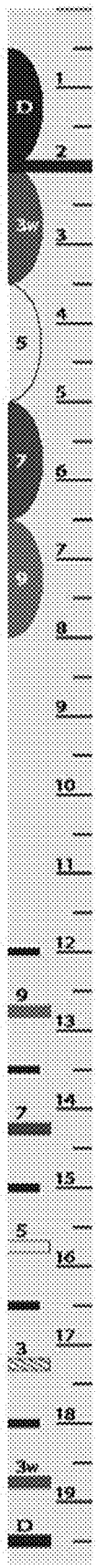
Fig. 8A
Fig. 7
Fig. 8B
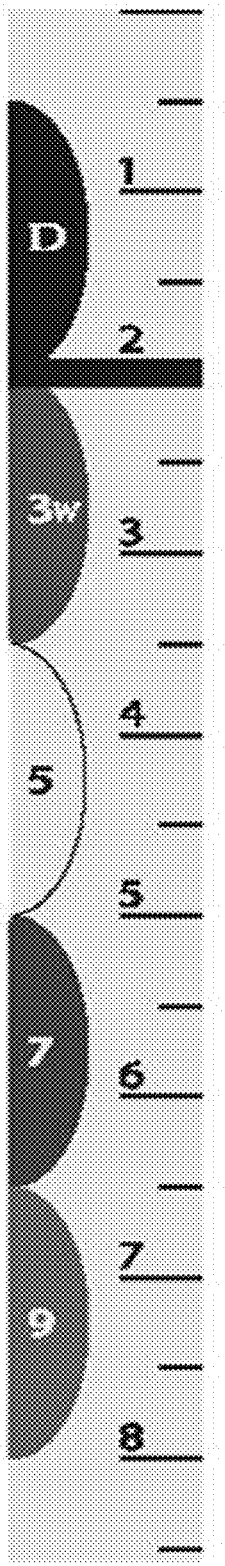
Fig. 8A
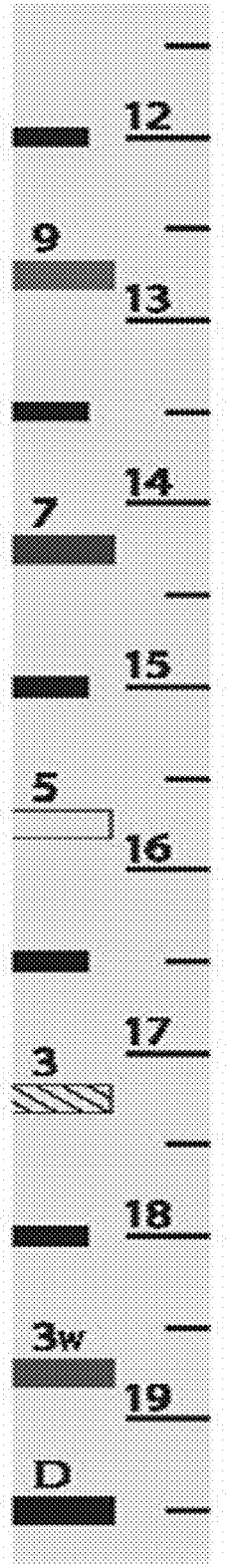
Fig. 8B

GOLF STANCE AND BALL ALIGNMENT DEVICE

CROSS-REFERENCE TO RELATED APPLICATIONS

The present application claims the benefit of domestic priority to U.S. Provisional Patent Application Ser. No. 61/154,755 filed Feb. 23, 2009, entitled "GOLF STANCE AND BALL ALIGNMENT DEVICE"; the aforementioned application is incorporated herein by reference.

TECHNICAL FIELD

The present invention, in general, relates to golf training and/or playing aids. More particularly, the present invention relates to a device that assists a golfer to correctly align his or her stance, feet and golf ball in order to properly and accurately strike the golf ball.

BACKGROUND ART

The game of golf includes many "basics" that can make the game difficult if not grasped by the player. For example, proper grip, posture, stance, alignment and ball position may all affect a player's performance. Unless a golfer is standing in front of a mirror or working directly with the instructor, it is often difficult for a student to determine whether the ball is properly positioned and aligned relative to his or her feet and target and whether he or she is accurately aiming to the target.

Various devices, systems and methods have been developed for the game of golf in an effort to improve one's skill level. More particularly prior U.S. patents disclose several devices for positioning a golfer's stance in relation to a ball to be struck and relative to the target. However, they do not offer a combination of simplicity of manufacture, cheap price, freedom of movement by the golfer during use as well as ease and scope of use, as provided by the present invention. Moreover, many of said prior art may practically be used on a practice ground whereas the present invention may practically be used during a game and/or during a practice and/or leisure round of golf, as it is not placed on the ground at any time and may be retracted during the stroke, while still providing the benefits stated hereinafter.

For example, U.S. Pat. No. 4,257,608 (Funk) discloses a "Golfer's Setup Device" comprising a pair of rulers, 40 and 80, mounted transversely to each other using an attachment that allows each ruler to slide along its length relative to the attachment. Two foot position and angle strips, 50 and 52, are slidably mounted on the main ruler. This device is highly flexible, but the user must calculate or look-up several angles and distances, slide the rulers to numbers on scales in two dimensions, slide the two foot position indicators to numbers on scales, and set the angles of the foot position strips. The correct numbers and angles for each golf club or range of clubs must be entered and referenced in a table. This is much more complicated to use than the present invention, and the construction is more expensive.

U.S. Pat. No. 4,354,683 (Wooland) discloses a "Golfer's Stance Positioning Aid". It is similar to Funk above, in providing a two-way slide connection between two transverse members, 10 and 12. Indicia on the transverse members are graduated in club numbers. It provides fine incremental adjustability, but is unnecessarily complex to use, since two adjustments must be made for each change of club.

Other systems focus on proper ball position in relation to a player's stance: some such systems include a mat with a first set of markings and/or lines thereon for aligning a player's feet, which correspond with a second set of markings for aligning a golf ball. Other devices provide a T-shaped or cross-shaped device having a first elongated measuring stick having markings for aligning a player's foot, and a second elongated stick perpendicular to the measuring stick for aligning the ball. Other devices include an elongated aiming rod that is secured to the shoe of the player. Such mats, measuring stick devices and aiming rods are relatively bulky and often difficult to set up and transport. In addition, many are impractical for use on a golf course. Furthermore, the markings or lines typically cannot be adjusted to account for different golfing styles, preferences or needs.

Prior art devices are characterized by one or more of the following shortcomings: they are relatively bulky and often difficult to set up, use and transport, many are used by placing them on the ground and hence are found in terrestrial contact with the environment, which makes them uncomfortable and practically not useful on a golf course. This is due to the fact that they may require the player to place the device on the ground first and only then get into position and align him or herself with the device; such devices do not offer much freedom of movement to change stance relative to target in an easy and straightforward manner, since normally the player would have to get out of position, bend down and move the device manually. Many other devices are very expensive and complex to manufacture. Last but not least, most existing devices are not designed and/or manufactured in order to enable the golfer to make their own marking on the device to suit their own personal needs and preferences. This is important as in golf not every position which is deemed the correct position will suit every golfer and also the "correct" position may change according to style, height and many other variables.

BRIEF DESCRIPTION OF THE DRAWINGS

The present invention will be understood and appreciated more fully from the following detailed description taken in conjunction with the appended drawings in which:

FIG. 7 is a top view of a preferred embodiment of the string or tape of the present invention;

FIGS. 8A and 8B, respectively, are enlarged views of the anterior and posterior portions of the string or tape shown in FIG. 7.

Figure 1:
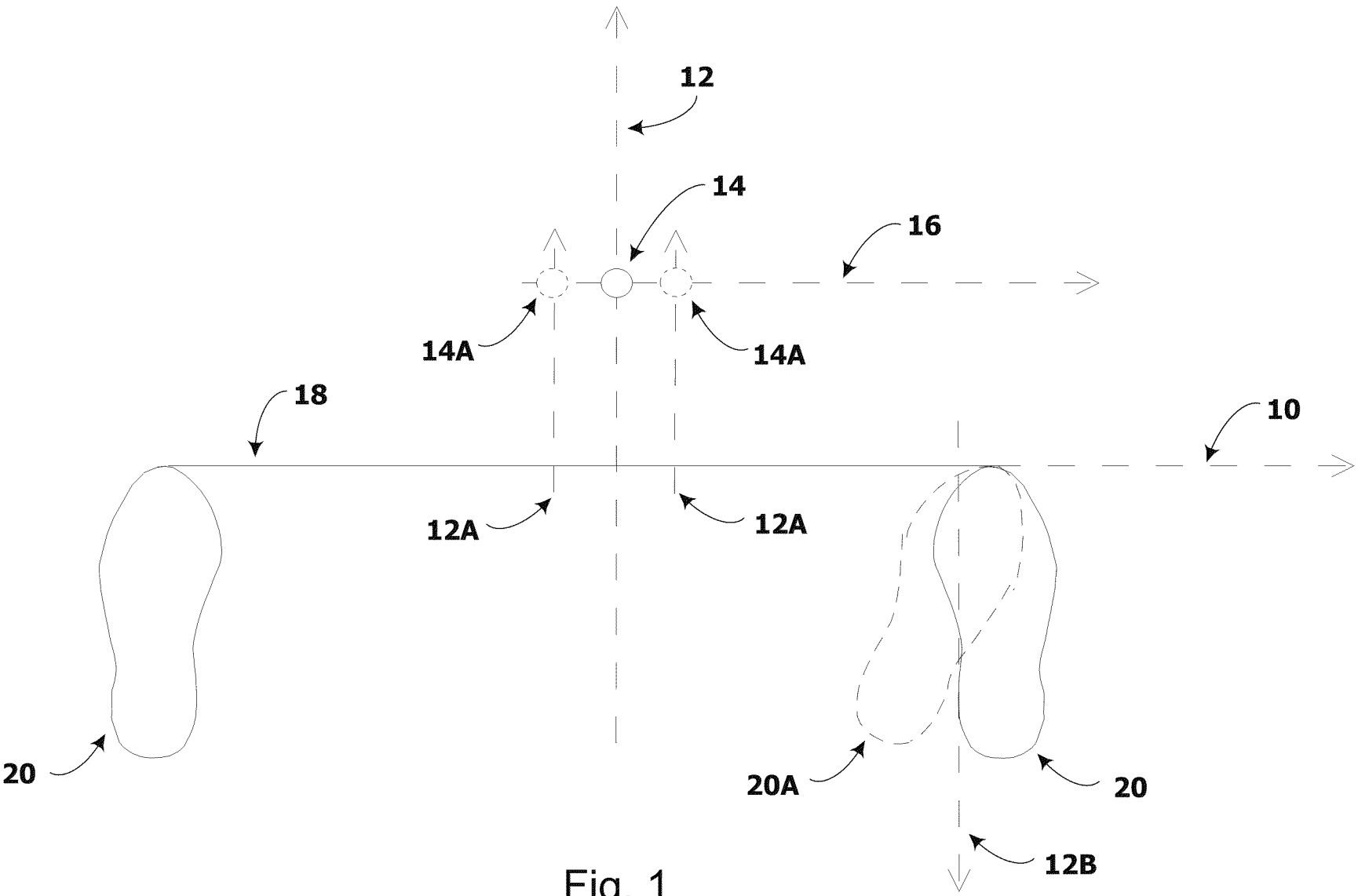
FIG. 1 is a schematic diagram outlining the geometrical constellation of the device of the present invention, golf ball and player's feet.

While the invention is susceptible to various modifications and alternative forms, specific embodiments thereof have been shown by way of example in the drawings. The components in the drawings are not necessarily to scale, emphasis instead being placed upon clearly illustrating the principles of the present invention.

SUMMARY OF THE INVENTION

There is provided, in accordance with some embodiments of the present invention, a golf stance and alignment device, which is characterized by the absence of any terrestrial contact with the golf course and by enabling the golfer to remove the device by him or herself, without getting out of the alignment.

One object of the present invention is to aid the golfer to properly align his or her body and feet with respect to a target line and/or a reference line.

Another object of the present invention is to aid the golfer to properly align both feet relative to each other and/or to the target line.

Another object of the present invention is to aid the golfer to properly align the angle of the feet, i.e. to a correct position of each foot's heels relative to its toes and/or relative to the ball and/or target line.

Another object of the present invention is to aid the golfer achieve the correct width of stance.

Another object of the present invention is to aid the golfer to properly position the ball with respect to his or her stance.

Another object of the present invention is to achieve all of the above with regard to different types of golf clubs and and/or enable all of the above while allowing for change of the markings on the device so that every golfer may adjust the markings according to their own personal needs or preferences.

DISCLOSURE OF THE INVENTION

Illustrative embodiments of the invention are described below. In the interest of clarity, not all features of an actual implementation are described in this specification. It will be appreciated that in the development of any such actual embodiment, numerous implementation-specific decisions must be made to achieve the developers' specific goals, such as compliance with system-related and business-related constraints, which vary from one implementation to another. Moreover, it will be appreciated that such a development effort might be complex and time-consuming, but would nevertheless be a routine undertaking for those of ordinary skill in the art having the benefit of this disclosure.

In accordance with some embodiments of the present invention, the golf stance and alignment device comprises a reel, a fastener preferably of the self-adherent type and a string or tape extending between them, having a first and second end wound on the reel and unwound therefrom in a retractable manner. The first end of the string or tape is connected to the reel, which typically is accommodated within a housing, whereas the second is connected to the fastener. The reel, or rather the housing of the reel, is attached to the first golfer's shoe. Examples of such self-retractable reels in the art are numerous and include U.S. Pat. No. 4,273,329. The self-adherent fastener, preferably to be used with the device of the invention, comprises two complimentary units that self-adhere to each other, upon being brought into proximity or physical contact. Examples of such fastener include, inter alia, clip, hook, Velcro or magnet. The first complimentary unit is connected to the second end of the string or tape, whereas the second complimentary unit is attached to the second golfer's shoe; whereby the golfer is able to easily connect the complimentary units by abutting his shoes and to unwind the string or tape from the reel by distancing his feet. The golfer can then release the units by applying an increased tension to the string or tape or by manipulating and deactivating the fastener, for instance by means of a golf club; whereby the string or tape is retracted into the housing. Disconnection of the string can be achieved by using the club head to lift the string away from the fastener or by using the club head to press on a lever—thus releasing the string or tape to be retracted back into the housing. Noticeably if the string is retracted after the set-up and alignment have been completed, but before the stroke is performed, it could be argued that the player may use the device during a game of golf and not only during practice; thus improving his or her results on the field.

In some embodiments the device of the invention comprises a linker, being a fragment of a string or tape, or a set of linkers providing for customizing the length of the string or tape per particular needs of the golfer. This type of customization is provided for dealing with different heights and/or preferences of players. In some embodiments the device of the invention is commercialized with a set of replaceable reels or a set of replaceable strings or tapes; thus the player can use the reel or the string or tape most personally suiting to her or his own height and/or preference.

Use of a wider tape which is not a round string have the added benefit of indicating if the player's feet are not parallel to each other. This will be indicated by that if the feet are not aligned in parallel to each other, the tape will twist or buckle and not remain flat, thereby the player can visually notice the twist and correct his foot position accordingly.

In yet another embodiment of the invention the device comprises a traditional or electronic spirit level that may be embedded within the housing or incorporated on the string or tape, to indicate the horizontality of the device.

In yet another embodiment of the invention the device may make a sound or reflect a light when the string has been retracted to the correct distance, or if the tape is twisted and not flat as described above, or to notify the player of any problematic position of the string.

According to one embodiment of the present invention, the housing includes an attachment device, such as a clip, that is configured to releasably secure the housing to the shoe of the golfer and to allow the string/tape to extend therefrom.

The housing and the second complimentary unit are preferably to be positioned substantially at the same place on each of the shoes, preferably as close to the front end of the shoe, to ensure the line generated by extending the string or tape is straight and at the right angle relative to the golfer's body, feet, ball and target line. The self-adherent fastener is optional as the second end of the string can be connected the to the shoe or any part thereof directly, e.g. by hooks, fasteners, etc.

In yet another embodiment of the invention some or all constituents of the device (housing, string, fastener, etc.) may be embedded or otherwise integrated in golf shoes or the soles thereof, during the manufacturing process of the shoe; thus upgrading the shoes and adding functionality thereto.

In yet another embodiment of the invention it is also possible to unwind the string or cord and lock it in position so one can lay it on the ground and use it like a stick if he or she so prefers. In such case the device does not need to be connected to the shoes at all. This locking mechanism may also enable the golfer to make personalized markings on the string or tape with ease while it is stretched along the ground (allowing for personal preferences and/or adjustments in accord with height of the player).

The string or tape is marked with at least two types of visibly distinct indicia that assist the golfer in achieving and maintaining the above-mentioned objects of the invention, as will be elaborated infra. Reference is now made to FIG. 1, schematically outlining the geometrical constellation of the device, golf ball and player's feet. The alignment achieved by the device of the present invention is exercised on a plane defined by abscissa 10 and ordinate 12 axes. Golf ball 14 is positioned on ordinate axis 12 at a certain distance above abscissa axis 10. Auxiliary vertical axes 12A of the first type parallel to ordinate axis 12 can be defined from both sides of axis 12 and can optionally be used for positioning of golf balls 14A on slanted golf course. Horizontal imaginary axis 16 intersecting at the point wherein golf balls 14 and/or 14A positioned, in parallel to abscissa axis 10, represents the preferred direction of advancement for the golf ball.

Alignment device 18 of the present invention is positioned coaxially with abscissa axis 10. Projection of the device towards the target (not shown) aids the golfer to envisage abscissa axis 10; thereby positioning of device 18 aids the golfer to select the correct direction for his shot. Contours 20 represent the footmarks of the golfer's shoes. Golfer's shoes are preferably to be positioned at a certain angle to alignment device 18 and to each other, and at a certain distance, which can vary upon different clubs, course conditions, etc. It should be acknowledged that the positioning of device 18 and axis 10 at the tips of the shoes is for exemplification purposes only and device 18 can equally be positioned at any other portion of the shoes. Auxiliary vertical axes of the second type, such as axis 12B, can be defined in parallel to ordinate axis 12 adjacently to predetermined locations along device 18 and can optionally be used for positioning of golfer's shoes at a prescribed angle to device 18 and/or axis 10. Thus if a shoe of the golfer is not positioned correctly relatively to axis 10, the inner flanking edges of the shoe, represented by contour 20A, will not be aligned with an auxiliary vertical axe, such as axis 12B; thereby providing an indication for the golfer regarding incorrect angular position of his foot.

Reference is now made to FIGS. 2A-5B, showing several exemplary types of indicia embedded or marked on the string or tape of the device, assisting the golfer in achieving and maintaining the above mentioned objects of the invention.

Figure 2A:
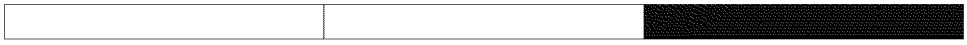
FIGS. 2A-2C are examples of the first type of indicia.
Figure 2B:
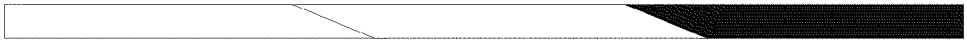
Figure 2C:
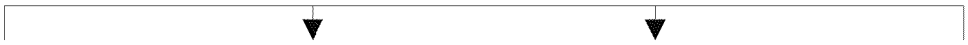

Examples of visibly distinct indicia of the first type are depicted at FIGS. 2A-2C. The first type of indicia aids the golfer to position his feet at predetermined distance, along the abscissa axis. In some instances the first type of indicia defines 2 or 3 spans, as shown in FIG. 2A; the spans may overlap, as shown in FIG. 2B. In other instances the first type of indicia defines specific locations along the device of the invention, as shown in FIG. 2C. A golfer using the device, typically, unwinds the string or tape from the reel, by distancing his feet, until the relevant indicia of the first type emerges from the housing.

Figure 3:
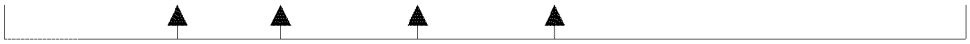
FIG. 3 is an example of the second type of indicia.

Example of visibly distinct indicia of the second type is depicted at FIG. 3. The second type of indicia is used for generating of an imaginary projection of the ordinate axis; whereby aiding the golfer to position the golf ball. It should be stressed that the ordinate axis can be projected from predetermined locations along the device of the invention, which may vary upon different clubs, course conditions, etc. The second type of indicia preferably comprises a visual enhancement, such as a linear mark, aiding the golfer to envisage a projection of the ordinate axis therefrom.

Figure 4A:
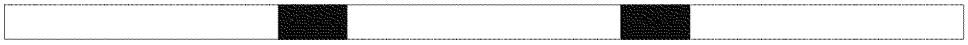
FIGS. 4A-4C are examples of the third type of indicia.
Figure 4B:
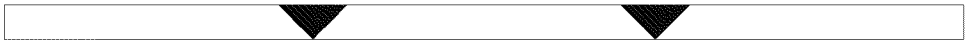
Figure 4C:
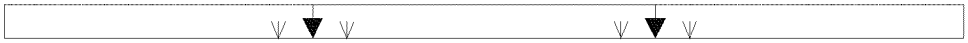

Examples of visibly distinct indicia of the third type are depicted at FIGS. 4A-4C. The third type of indicia is used for generating of an imaginary projection of an auxiliary axis of the second type; whereby aiding the golfer in positioning of his feet in the correct angle relative to the abscissa axis. In some instances the third type of indicia defines 2 or 3 spans, as shown in FIG. 4A; the spans may indicate a preferred position for the tip of the shoe, as shown in FIG. 4B. In other instances the third type of indicia defines locations along the device of the invention, as shown in FIG. 4C. The third type of indicia can be combined with or accompany the first type of indicia. A golfer using the device, typically, distances his feet, in accordance with the first type of indicia, and then positions his feet in the correct angle relative to the device by verifying that an imaginary projection of the auxiliary vertical axis or axes of the third type substantially are aligned with the inner flanking edge of his shoes and not intersects therewith.

Figure 5A:
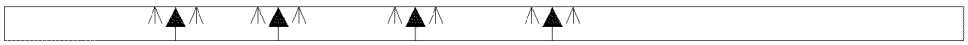
FIGS. 5A and 5B are examples of the fourth type of indicia.
Figure 5B:
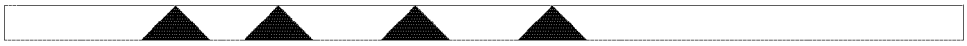

Examples of visibly distinct indicia of the fourth type are depicted at FIGS. 5A and 5B. The fourth type of indicia is used for generating of an imaginary projection of an auxiliary axis of the first type; whereby aiding the golfer to position the golf ball on an auxiliary axis of the first type adjacently to the ordinate axis. In some instances the fourth type of indicia defines locations along the device of the invention, as shown in FIG. 5A; whereas in other instances this type of indicia defines 2 or more ranges, which preferably indicate the location of the ordinate axis, as shown in FIG. 5B. The fourth type of indicia can be combined with or accompany the second type of indicia. A golfer using the device may opt to position the golf ball on an imaginary projection of the auxiliary vertical axis of the first type. The fourth type of indicia may present a scale of marks, optionally with numeric values, to represent the correct ball position according to the extent to which the golf course is slanted.

A fifth type of visibly distinct indicia can be applied by the golfer onto the device in a customized manner. The fifth type of indicia is aimed to customize the device per particular playing habits or individual needs of the golfer. The fifth type of indicia is typically but not necessarily implemented with and/or alongside the fourth type of indicia; thereby the golfer can adjust the location of the mark used for imaginary projection of an auxiliary vertical axis on which is the golf ball is positioned, to correct the position of the ball defined, preferably by the fourth type of indicia, to suit his needs. The device of the invention is preferably to be commercialized with compatible marker for applying the fifth type of indicia.

BEST MODE FOR PRACTICING AND CARRYING OUT THE INVENTION

Figure 6A:
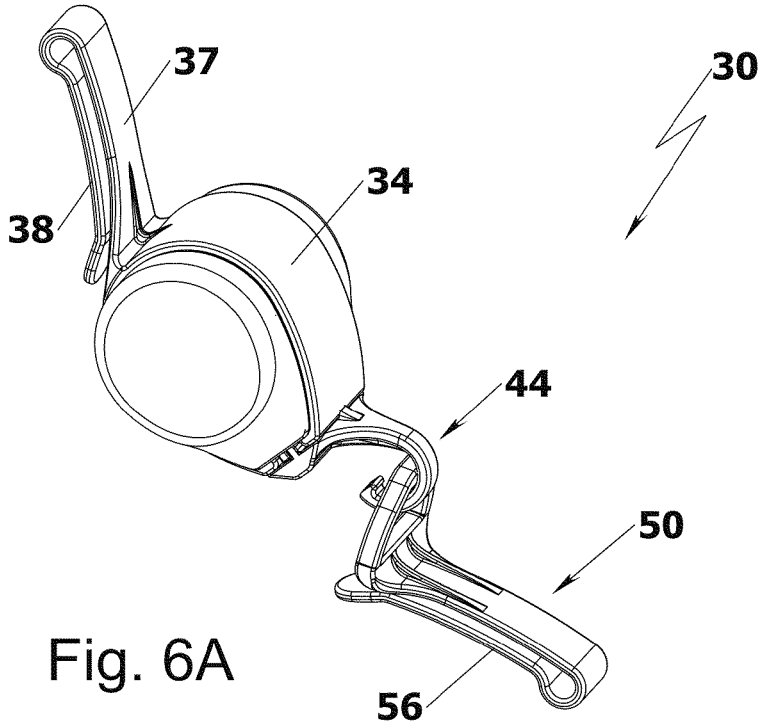
FIG. 6A is an isometric view of a preferred embodiment of the device of the present invention.
Figure 6B:
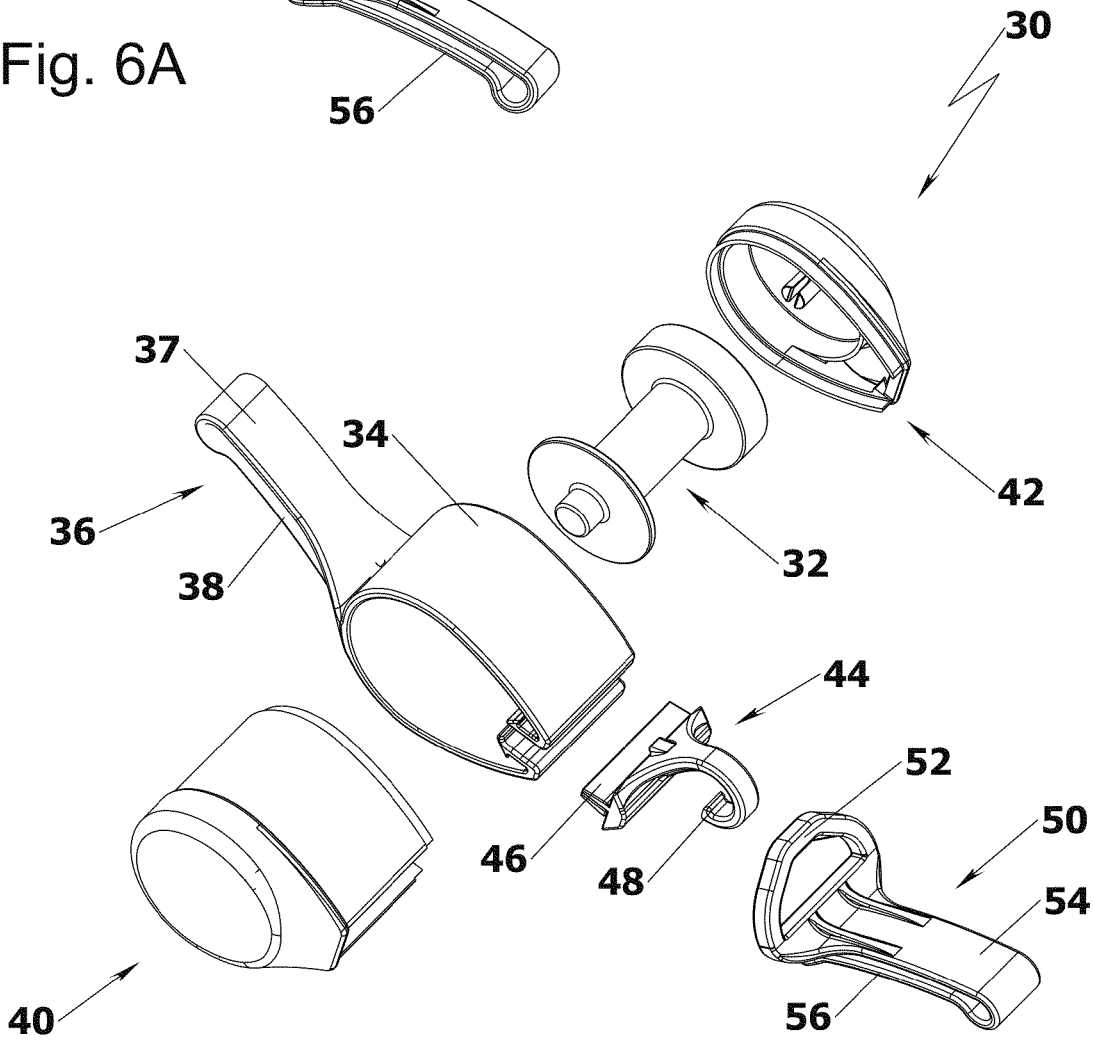
FIG. 6B is an exploded view of the device shown in FIG. 6A.

In accordance with some preferred embodiments of the present invention, reference is now made to FIGS. 6A and 6B, showing device 30, used for achieving a correct stance, ball position and alignment in the game of golf. Device 30 comprises reel 32, which is accommodated in housing 34. Reel 32 comprises a spiral leaf rendering it self-retractable. Housing 34 comprises extending slanted clip 36, formed by adjacent plates 37 and 38. Slanted clip 36 is used to affix housing 34 to a shoe (not shown) of a golf player. Housing 34 and reel 32 are enclosed by shell 40 and covered by lid 42. The first end of the tape (not shown) is connected to the central portion of reel 32 and the rest of the tape wound therearound. The second end of the tape is connected to first complimentary fastener unit 44, by the means of clasping plates 46. First complimentary fastener unit 44 comprises hook portion 48. First complimentary fastener unit 44 is releasably connectable to second complimentary fastener unit 50 by inserting hook portion 48 of the former into loop 52 of the latter. Second complimentary fastener unit 50 comprises extending slanted clip formed by adjacent plates 54 and 56. Slanted clip 36 is used to affix housing unit 50 to the other shoe (not shown) of the aforesaid golf player, vis-à-vis slanted clip 36.

In accordance with some preferred embodiments of the present invention, reference is now made to FIGS. 7 to 8B, showing the tape used with the device of the invention. The tape shown in FIG. 7 extends in-between reel 32 and first complimentary fastener unit 44, being clasped by plates 46, shown in FIGS. 6A and 6B. The tape preferably comprises apertures at the terminal portions thereof, whereby the tape can be laid down on the ground and pinned to it, for instance by sticking a golf tee in each apertures; this is useful for calibrating the device to ones personal needs. Anterior portion shown in FIG. 8A of the tape shown in FIG. 7 embodies a preferred instance of indicia of the second type. Arcuate shaded shapes apparent in tandem on the left side of the tape indicate the preferred position of the ball, i.e. the ordinate axis. The alphanumerical indicia within the aforesaid arcuate shaded shapes, indicates the types of the clubs employed. The tip of the arcuate shapes assists to project an imaginary ordinate axis. The arcuate shapes may include additional alphanumerical indicia or be alternatively sized, to indicate the preferred distance of the ball on ordinate axis from the tape, i.e. the abscissa.

Posterior portion shown in FIG. 8B of the tape shown in FIG. 7 embodies a preferred instance of indicia of the first type. Rectangular marks on the left side of the tape indicate the preferred distance for the second shoe. The alphanumerical indicia above the aforesaid shapes, indicates the types of the clubs employed.

Preferably the instances of indicia of the first type respectively correlate to the instances of indicia of the second type, corresponding to the particular club used.

The left side of the tape is furnished with graduations, employed to assist applying the fifth type of personalized indicia.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

The invention claimed is:

1. A device for achieving a correct stance, ball position and alignment in the game of golf, said device comprising:

a self-retractable reel, said reel comprising a biasing means, said reel is attachable to the first shoe of a golf player;

a string or tape having a first end and a second end, wherein said first end of said string or tape is connected to said reel, and wherein said string or tape is respectively wound/unwound onto/from said reel, and a fastener, said fastener comprising two complimentary units which are connectable to each other; wherein the first complimentary unit is connected to said second end of said string or tape, and wherein the second complimentary unit is attachable to the second shoe of said golf player;

wherein said string or tape comprises at least a three types of visibly distinct indicia selected from the group consisting of: a first type of visibly distinct indicia, a second type of visibly distinct indicia, graduations employed to assist applying a fifth type of personalized indicia.

2. The device as in claim 1, further comprising a housing, accommodating said reel.

3. The device as in claim 1, wherein said string or tape further comprising a fifth type of visibly distinct indicia, applied to said device in a customized manner.

4. A kit-of-parts comprising the aiding device as set forth in claim 3 and a marker for applying said fifth type of visibly distinct indicia.

5. The device as in claim 1, wherein said fastener comprises a loop and a hook.

6. The device as in claim 1, wherein said fastener is a self-adherent fastener; wherein said complimentary units adhere upon being brought into proximity or physical contact.

7. The device as in claim 1, wherein said second type of visibly distinct indicia comprises arcuate shapes.

8. The device as in claim 7, wherein said second type of indicia further comprises alphanumerical indicia, indicating the types of the clubs employed.

9. The device as in claim 7, wherein said arcuate shapes are alternatively sized, to indicate the preferred distance of the ball from said tape.

10. The device as in claim 1, wherein said second type of visibly distinct indicia is accompanied by a forth type of visibly distinct indicia.

11. The device as in claim 1, wherein said first type of indicia comprises an essentially rectangular marks.

12. The device as in claim 1, wherein said first type of indicia is accompanied by a third type of visibly distinct indicia.

13. The aiding device as in claim 12, wherein said reel is of a self-retractable type.

14. The aiding device as in claim 12, further comprising a housing, accommodating said reel.

15. The aiding device as in claim 12, wherein said fastener is a self-adherent fastener; wherein said complimentary units adhere upon being brought into proximity or physical contact.

16. The aiding device as in claim 12, wherein said string or tape further comprising a linker or a set of linkers.

17. The aiding device as in claim 12, wherein said string or tape further comprising a third type of visibly distinct indicia and/or a fourth type of visibly distinct indicia.

18. The aiding device as in claim 12, wherein said string or tape further comprising a fifth type of visibly distinct indicia, applied to said device in a customized manner.

19. A kit-of-parts comprising the aiding device as set forth in claim 18 and a marker for applying said fifth type of visibly distinct indicia.

20. An aiding device used for achieving correct stance, ball position and alignment for playing golf, said device comprising:

a reel, said reel is attachable to a first shoe of a golf player;

a string or tape having a first end and a second end, wherein said first end of said string or tape is connected to said reel, and wherein said string or tape is wound/unwound respectively onto/from said reel, and;

a fastener, said fastener comprising two complimentary units which are connectable to each other; wherein the first complimentary unit is connected to said second end of said string or tape, and wherein the second complimentary unit is attachable to the second shoe of said golf player;

wherein said string or tape comprises at least a first type of visibly distinct indicia and a second type of visibly distinct indicia.

* * * * *